United States Patent [19]

Rosenberger

[11] Patent Number: 5,029,495

[45] Date of Patent: Jul. 9, 1991

[54] COMBINATION RING/CAN-OPENER

[76] Inventor: Charles T. Rosenberger, 1023 16th Ave. North, South St. Paul, Minn. 55075

[21] Appl. No.: 529,211

[22] Filed: May 25, 1990

[51] Int. Cl.[5] ..... B67B 7/44

[52] U.S. Cl. ..... 81/3.09; 81/3.55

[58] Field of Search ..... 7/151, 152; 81/3.09, 81/3.55

[56] References Cited

U.S. PATENT DOCUMENTS

| | | | |
|---|---|---|---|
| 706,911 | 8/1902 | Dunham | 81/3.09 X |
| 814,834 | 3/1906 | Coughlin | 81/3.09 X |
| 4,667,544 | 5/1987 | Milo | 81/3.55 X |
| 4,825,728 | 5/1989 | Mitchell | 81/3.55 X |
| 4,905,335 | 3/1990 | Tervola | 7/151 X |

*Primary Examiner*—James G. Smith

*Attorney, Agent, or Firm*—Vidas & Arrett

[57] ABSTRACT

A combination ring/can-opener which provides a readily accessible, quick and easy method for opening beverage cans which utilize tab or ring openers.

9 Claims, 2 Drawing Sheets

COMBINATION RING/CAN-OPENER

BACKGROUND OF THE INVENTION

1. Field of the Invention

This invention relates to a finger ring/can-opener combination and method of opening beverage cans.

2. Description of the Related Art

People such as bartenders and cocktail waitresses and waiters are required to open large numbers of beverage cans which utilize tab or ring openers. It can be difficult to lever open the tab or ring opener, often requiring that a finger or finger nail be wedged between the tab opener and the beverage can top. This often results in damage to finger nails, especially people with long finger nails. What is needed is a device which can be used by bartenders, cocktail waitresses or waiters, as well as other consumers, to easily open one or more beverage cans. The device may also function as an advertising vehicle to increase name recognition of any beverage company which chooses to provide the inventive device as a promotional item.

SUMMARY OF THE INVENTION

Meeting the need described above, applicant has invented the combination ring/can-opener described below. This device consists of a standard ring blank which has been modified to provide a "hook" which can be used to open beverage cans. The combination ring/can-opener can be cast as one piece, and made of stainless steel, although it may be made of any hardened metal or other suitable material. Therefore, the cost of this ring is relatively inexpensive, lending itself to mass production. Custom bezels may be attached to the ring which contain a beverage company's name, logo, insignia, trademark, or other advertisement. The ring can then be provided to establishments that purchase that beverage company's product. Use of this ring by employees of the establishment will increase the name recognition of the beverage company whenever the employee opens a beverage can using the ring. The ring could also be provided with every 6-pack, case, or package of a beverage companies product, allowing the consumer to use this inexpensive opener to open the beverage cans, and incidentally increase the name recognition of the beverage company supplying it.

By "hooking" the tab or ring opener with the "hook" and quickly moving or rotating the hand, the tab opener is levered upward, thereby opening the can. Applicant has found by experimentation that it is much faster to open a beverage can using the inventive ring, than to use fingers or finger nails. It is also much faster to open a large number of beverage cans, and prevents damage to the wearer's fingers and finger nails.

DESCRIPTION OF THE PREFERRED EMBODIMENTS

Figure 1:
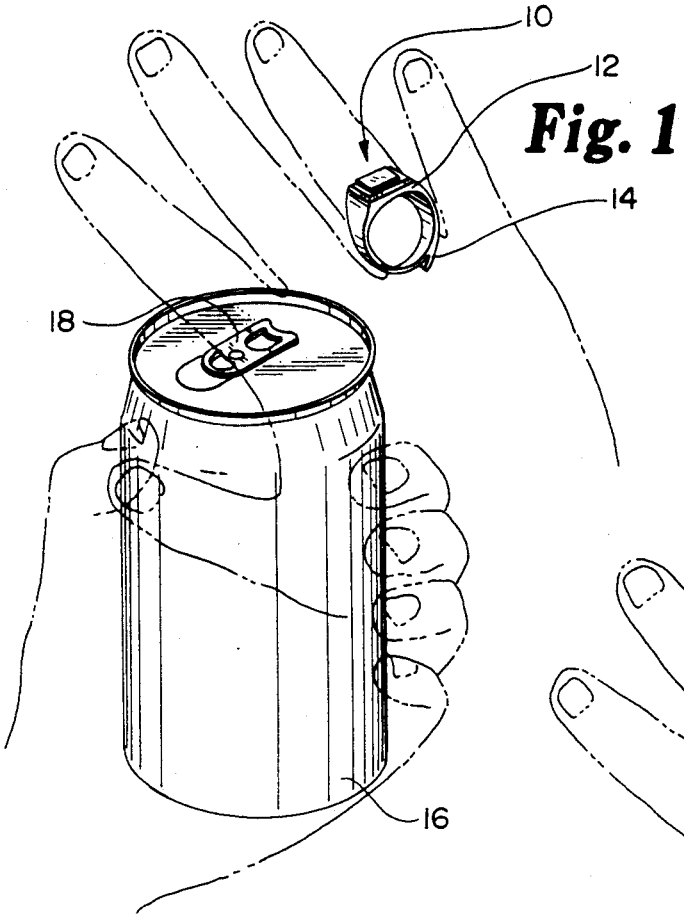
FIG. 1 is a perspective view of the inventive ring/-can-opener shown prior to engagement with a tab opener on a can to be opened.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

Figure 2:
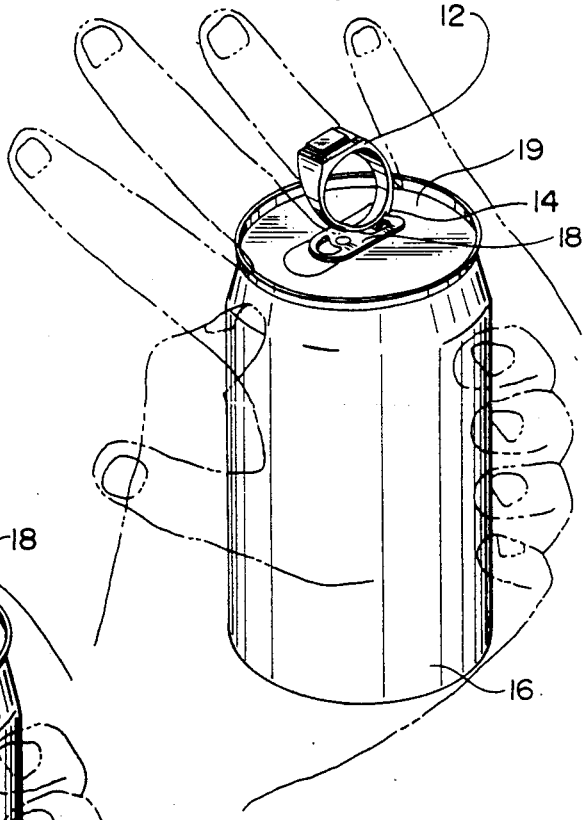
FIG. 2 is a perspective view showing engagement of the ring with a tab opener on a beverage can.
Figure 3:
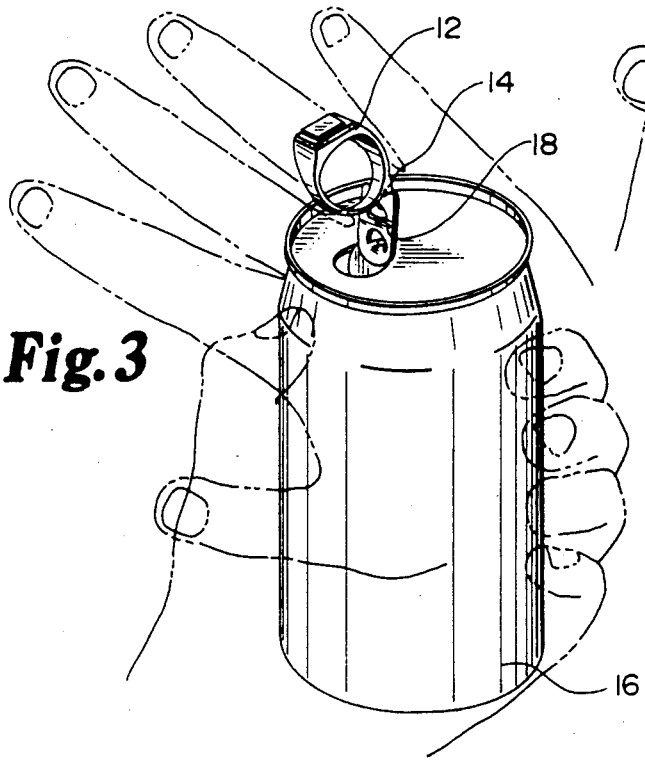
FIG. 3 is a perspective view showing the beverage can opened due to rotation of the hand wearing the inventive ring.
Figure 4:
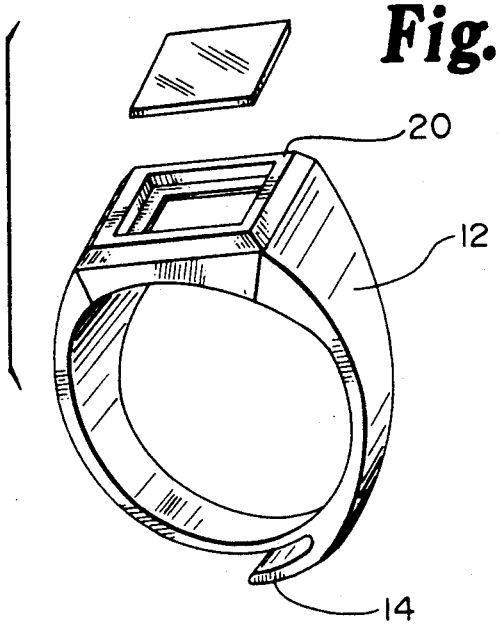
FIG. 4 is a perspective view of the ring.
Figure 5:
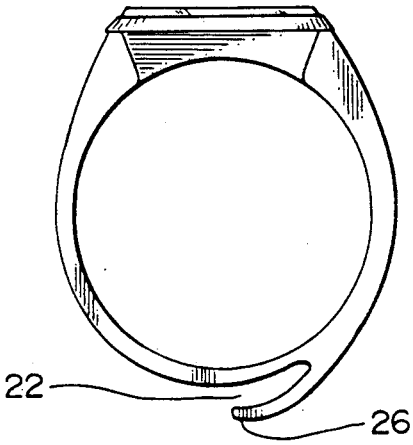
FIG. 5 is a front elevational view of the ring.
Figure 6:
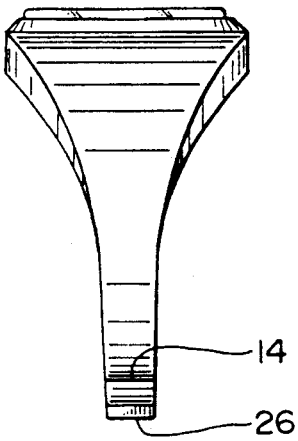
FIG. 6 is a side elevational view of the ring looking directly at the gap between the "hook" and the bottom of the ring.
Figure 7:
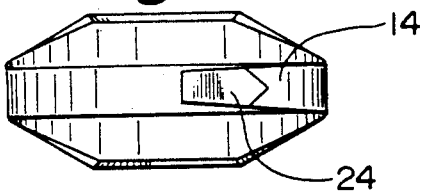
FIG. 7 is a bottom plan view of the ring.
Figure 8:
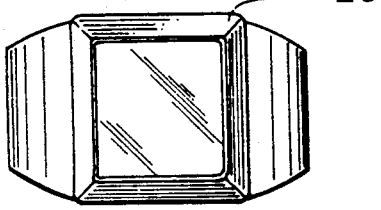
FIG. 8 is a top plan view of the ring.
Figure 9:
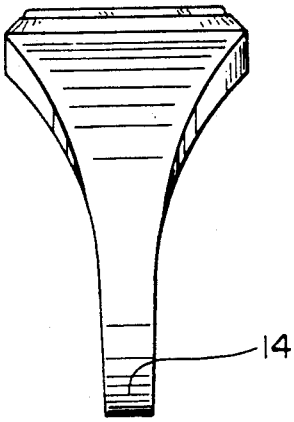
FIG. 9 is a side elevational view showing the side opposite that shown in FIG. 6.

Referring now to FIGS. 1 through 3, the method of using the inventive finger ring/can-opener is shown. The inventive ring is shown generally at 10 and is shown worn preferably on the ring finger of the right hand. Ring 10 can be made in all sizes and may be worn on any convenient finger or thumb and on either the right or left hand. It is contemplated that ring 10 will be cast as one piece, as is well known in the art of ring making. Ring 10 is made up of a ring blank 12 as is well known in the art, and includes a hook 14 which is cast with the ring blank 12. In the preferred embodiment, the ring/can-opener is made of stainless steel, to make the cost of the ring as inexpensive as possible. However, the ring could be made of any hardened metal or alloy, as well as other suitable materials. Also, more expensive rings could be manufactured or modified to utilize the inventive concept disclosed herein.

FIG. 1 shows the wearer holding a beverage can 16 which uses a tab opener arrangement 18. Opener 18 may be of the tab, ring or other variety, as long as it provides something for hook 14 to engage with to "open" the can 16. FIG. 2 shows ring 10 with hook 14 engaging tab opener 18. Hook 14 is inserted between the tab 18 and the top 19 of the beverage can 16. Finally, FIG. 3 shows the can opened after the wearer has rotated or moved his hand from right to left, thereby exerting force on the tab 18 which forces the tab upward and opens the beverage can. It should be noted that the ring is adapted to be ordinarily worn such that the top of the ring is oriented toward the knuckle side of the hand and the bottom side of the ring is oriented toward the palm side of the hand.

Referring now to FIGS. 4 through 9 various views of the inventive ring 10 are provided. Ring 10 is comprised of ring blank 12 and hook 14. Ring blank 12 has a flat crown 20 equipped with bezel 21. It is well known in the art of ring making to attach a bezel to a ring blank using a variety of methods, such as adhesives, soldering or the like. Bezel 21 could be any prior art bezel, such as a gem or stone as shown, or could be a plastic bezel which incorporates a logo, trademark, insignia or company name of a beverage company, such as a beer or soft drink company. Ring 10 may also be manufactured as a ring blank without a bezel to make a less expensive embodiment of the invention.

Hook 14 is attached to the lower portion of the bottom or "palm" side of the ring. As shown best in FIG. 5, the hook consists of a piece of material which extends a portion of the circumference of the palm side of the ring blank 12, to provide a gap or bite 22. As shown best in FIG. 7, in the preferred embodiment the bottom 24 of hook 14 is flat, and the point 26 of the hook 14 is thinner so that the hook can be more easily inserted between the tab or ring opener 18 and the top 19 of a beverage can.

Ring 10 will be fairly inexpensive to mass produce in any shape or size. The shape of the ring as shown herein is for example purposes only. Because it will be inexpensive to manufacture it is contemplated that a beverage company could include one or more of the inventive rings with every package or case of beer, 6-pack or case of soft drink and the like, or with any other type of package of beverage which could be opened with the inventive ring 10. The beverage company may equip the ring with a custom bezel which could provide name recognition and inexpensive advertising for the beverage company, while providing the customer with a handy and quick opener.

Applicant has observed that many consumers have trouble opening beverage cans which utilize openers such as tab or ring openers 18. Many consumers have trouble wedging a finger tip or finger nail between the tab 18 and the top of the can 19. Also, it may be fairly difficult to lever open the tab to open the can. Many consumers break their finger nails in the process of opening the can, especially consumers with long finger nails. This is especially true of people who are required to open large numbers of beverage cans, such as bartenders or cocktail waiters or waitresses.

Bartenders and cocktail waiters or waitresses will certainly benefit from direct purchase of applicant's inventive ring. However, it is contemplated that beer or soft drink companies will provide these rings to establishments that purchase their product, equipped with a custom bezel to generate name recognition. Much the same way that many bartenders or waiters and waitresses are provided with T-shirts for advertising purposes. The consumer will notice the name of the beverage company every time a bartender or waitress opens whatever beverage the consumer had just ordered. A bartender or waitress using applicant's inventive ring/-can-opener can open a row of cans in just a few seconds without injury to their finger tips or finger nails. In fact applicant has discovered experimentally that it is much faster to open cans using the inventive ring/can-opener than by using fingers tips or finger nails.

This completes the description of the preferred and alternate embodiments of the invention. Those skilled in the art may recognize other equivalents to the specific embodiment described herein which equivalents are intended to be encompassed by the claims attached hereto.

What is claimed is:

1. A combination ring/can-opener comprising:

a ring having a top side and a bottom side, the ring being adapted to be ordinarily worn such that the top side is oriented toward the knuckle side of a hand and the bottom side is oriented toward the palm side of the hand, and can opener means attached to the bottom side of the ring for opening containers having a ring or tab opener, the can opener means being utilized by performing a rotating motion of the ring/can opener gripping the ring or tab opener with the can opener means thereby opening the can.

2. The ring/can opener of claim 1 wherein said adaption comprises a bezel attached to the top of the ring.

3. The ring/can opener of claim 2 wherein the ring is substantially circular and defines a finger or thumb receiving opening, the ring having an inside and outside surface, and the can opener means is comprised of a hook attached to the outside bottom of the ring so as to define a gap between the hook and the outside bottom of the ring, whereby a can may be opened by inserting a tab or ring opener into the gap and moving the hand wearing the ring in a rotating motion, the palm of the hand positioned substantially over the can to be opened, the hook of the ring/can opener grips and pulls the tab or ring of the can upward, as the hand rotates over the can, thereby opening the can.

4. The ring/can-opener of claim 3 wherein the bezel contains the name, logo, insignia, trademark, or other advertisement of a beverage company or the like.

5. A ring for use in opening cans of the type utilizing tab or ring openers, comprising:

a ring having a top side and a bottom side, the ring being adapted to be ordinarily worn such that the top side is oriented toward the knuckle side of a hand and the bottom side is oriented toward the palm side of the hand, an inside and outside surface, and a can opener means attached to the bottom outside surface of the ring, for opening containers by positioning the hand wearing the ring over the tab or ring opener of the container and with the palm facing substantially toward the can, rotating the hand over the ring or tab opener of the can, gripping the ring or tab opener with the can opener means and pulling upwardly, thereby opening the can.

6. The ring of claim 5 wherein said adaption comprises a bezel attached to the top of the ring.

7. The ring/can-opener of claim 6 wherein the ring is substantially circular and defines a finger or thumb receiving opening, and the can opener means is comprised of a hook attached to the bottom outside surface of the ring so as to define a gap between the hook and the outside surface of the ring, whereby a can may be opened by positioning the hand wearing the ring with the palm substantially facing the can and inserting the hook into and rotating over a tab or ring opener to grip and pull the tab or ring upward, thereby opening the can.

8. The ring/can-opener of claim 7 wherein the bezel contains the name, logo, insignia, trademark, or other advertisement of a beverage company or the like.

9. A method of opening a can of the type having a ring or tab opener, comprising the steps of:

wearing a ring on any convenient finger or thumb of either hand, the ring defining a finger or thumb receiving opening, and having an inside and outside surface, and a top side and a bottom side, the ring being adapted to be ordinarily worn such that the top side is oriented toward the knuckle side of a hand and the bottom side is oriented toward the palm side of the hand, the ring including can opener means which is comprised of a hook attached to the bottom outside surface of the ring so as to define a gap between the hook and the outside surface of the ring;

inserting the tab or ring opener into the gap between the hook and the outside surface of the ring, and moving the ring in a rotating motion wherein the palm of the hand is positioned such that the hook of the ring grips and pulls the tab or ring opener of the can forcing the tab or ring opener upward, thereby opening the can.

* * * * *